US005099921A

United States Patent [19]

Puri et al.

[11] Patent Number: 5,099,921

[45] Date of Patent: Mar. 31, 1992

[54] RECOVERY OF METHANE FROM SOLID CARBONACEOUS SUBTERRANEAN FORMATIONS

[75] Inventors: Rajen Puri; Dan Yee; Robert S. Metcalfe, all of Tulsa, Okla.

[73] Assignee: Amoco Corporation, Chicago, Ill.

[21] Appl. No.: 653,826

[22] Filed: Feb. 11, 1991

[51] Int. Cl.[5] ..... E21B 43/16; E21B 43/24; E21B 43/40

[52] U.S. Cl. ..... 166/266; 166/271; 166/272; 166/274; 299/10

[58] Field of Search ..... 166/274, 271, 272, 266, 166/245; 299/4, 7, 10, 14

[56] References Cited

U.S. PATENT DOCUMENTS

| | | | |
|---|---|---|---|
| 3,208,516 | 9/1965 | Prats | 166/245 |
| 3,297,088 | 1/1967 | Huitt et al. | 166/294 X |
| 3,565,173 | 2/1971 | Anderson | 166/271 X |
| 4,043,394 | 8/1977 | Every et al. | 166/263 |
| 4,086,964 | 5/1978 | Dilgren et al. | 166/252 X |
| 4,130,164 | 12/1978 | Datta | 166/159 |
| 4,283,089 | 8/1981 | Mazza et al. | 299/16 |
| 4,400,034 | 8/1983 | Chew | 299/5 |
| 4,883,122 | 11/1989 | Puri et al. | 166/263 |
| 5,014,785 | 5/1991 | Puri et al. | 166/266 X |

*Primary Examiner*—Stephen J. Novosad
*Attorney, Agent, or Firm*—Marcy M. Lyles

[57] ABSTRACT

A method of recovering methane from a solid carbonaceous subterranean formation by injecting a fluid that desorbs methane through at least one injection well into a subterranean formation and recovering desorbed methane through at least one production well. The initial rate of injection of the desorbing fluid can be increased without exceeding formation pressure limitations by injecting a preflush fluid having a desorbing efficiency less than a desorbing efficiency of the first fluid. This increase in injection of the desorbing fluid results in an increase in the recovery rate of methane.

14 Claims, 2 Drawing Sheets

RECOVERY OF METHANE FROM SOLID CARBONACEOUS SUBTERRANEAN FORMATIONS

BACKGROUND OF THE INVENTION

1. Field of the Invention

The present invention relates to methods of recovering methane from solid carbonaceous subterranean formations and, more particularly, to methods of increasing the recovery rate of the methane.

2. Setting of the Invention

In the recovery of methane from subterranean formations of solid carbonaceous material, a rapid recovery of methane is desired so that income from the sale of methane can be increased. Currently, the rate of methane recovery in most projects is dependent on how rapidly the formation pressure adjacent production wells can be decreased One method that does not depend upon formation pressure decrease to recover methane involves the injection of a gas into the subterranean formation to cause methane to be desorbed by displacement or stripping. Examples of this method are disclosed in Puri et al., U.S. Pat. No. 4,883,122. This method has the potential to significantly increase the overall volume of methane recovered in the project, as well as increase the rate of methane recovery over methods that depend upon formation pressure decrease.

The rate of methane recovery is directly related to the rate of desorbing gas injection, so to increase the rate of recovery, a project operator desires to increase the gas injection rate. However, the gas injection rate is controlled by the near wellbore permeability, which in turn is influenced by the gas content within water in the cleat system of the subterranean formation. For example, the injected gas cannot flow with ease into the solid carbonaceous subterranean formation until the cleat system is dewatered or until the cleat system has changed from being water saturated to gas saturated. This flow restriction is referred to as a relative permeability effect. Increasing the injection rate to overcome the relative permeability effect is restricted because a higher injection rate results in a higher wellbore bottomhole pressure. If the wellbore bottomhole pressure exceeds the fracture pressure of the solid carbonaceous subterranean formation then the injected gas will flow relatively quickly and preferentially into the resulting fractures and pass out into the subterranean formation without adequately contacting the near wellbore area to change the area to being gas saturated.

SUMMARY OF THE INVENTION

The present invention is a method of recovering methane from a solid carbonaceous subterranean formation that is penetrated by at least one injection well and at least one production well. In the method, a first fluid that desorbs methane is injected into the subterranean formation through at least one injection well. A second fluid, that desorbs methane and which has a desorbing efficiency less than the first fluid, is injected into the subterranean formation through at least one injection well. Desorbed methane moves through the subterranean formation towards areas of relatively lower pressure adjacent the wellbores of the at least one production well and is recovered through the at least one production well.

The problem of the relative permeability effect limiting the injection rate of the desorbing fluid is overcome by selecting a second fluid that has a desorbing efficiency less than the first fluid. Preferably, the first fluid does not significantly sorb to the solid carbonaceous material so that it will relatively rapidly pass into solution with the inplace water and methane adjacent the wellbore of the at least one injection well. Therefore, the cleat system changes from being water saturated to gas saturated relatively rapidly because little to none of this first fluid is adsorbed to the solid carbonaceous material. Thereafter, the second fluid is injected and the methane recovery project progresses a desired.

The rate of second fluid injection is greater for the same bottomhole wellbore pressure limitations and for the same period of time in the project than that which would have been possible without the prior injection of the first fluid. This results in a greater volume of desorbing gas injected and an increase in the rate of methane recovered.

DETAILED DESCRIPTION OF THE PREFERRED EMBODIMENTS

The present invention is a method of recovering methane from solid carbonaceous subterranean formation penetrated by at least one injection well and at least one production well. Specifically, in the preferred method of the present invention a first fluid that desorbs methane is injected into the solid carbonaceous subterranean formation through at least one injection well. The first fluid desorbs methane, as will be described below, and aids in moving desorbed methane towards areas of relatively lower pressure adjacent wellbores of at least one production well. A second fluid that desorbs methane is injected into the subterranean formation through at least one injection well; the second fluid having a desorbing efficiency less than a desorbing efficiency of the first fluid. Desorbed methane is recovered through the at least one production well. By injecting the relatively low sorbing first fluid prior to the second fluid, the cleat system of the solid carbonaceous material will become gas saturated more quickly than as compared to a methane recovery method which uses the injection of the second fluid alone.

As used herein the term "desorbing efficiency" means the volume of methane desorbed per volume of injected desorbing fluid. A relatively low desorbing efficiency means that the injected fluid has become sorbed to the solid carbonaceous material; an example of a fluid with a relatively low desorbing efficiency is carbon dioxide. A relatively high desorbing efficiency means that no significant volume of the injected fluid has become sorbed to the solid carbonaceous material; examples of fluids with a relatively high desorbing efficiency is nitrogen with helium having a higher desorbing efficiency than nitrogen.

As used herein, the term "solid carbonaceous material" means any subterranean material that contains natural gas, usually in the form of methane. Examples of such solid carbonaceous material can be any type of coal, gas shale, or the like.

As used herein, the term "fluid" means one or more gases, one or more liquids or combinations of these that will desorb methane from a solid carbonaceous material by stripping, displacement, or combinations of these.

The preferred method of the present invention can be used as part of any methane desorbing project that involves the injection of a fluid into solid carbonaceous material to desorb methane, such as prior to a UCG project, prior to mining, or purely for the recovery of methane. Examples of such methods are disclosed in Every, et al. U.S. Pat. No. 4,043,395; Mazza, et al. U.S. Pat. No. 4,283,089; Chew U.S. Pat. No. 4,400,034; and Datta U.S. Pat. No. 4,130,164. Most preferably, the methods of the present invention are used as part of a project to recover methane which involves the injection of a gas to desorb methane as disclosed in Puri U.S. Pat. No. 4,883,122.

Figure 1:
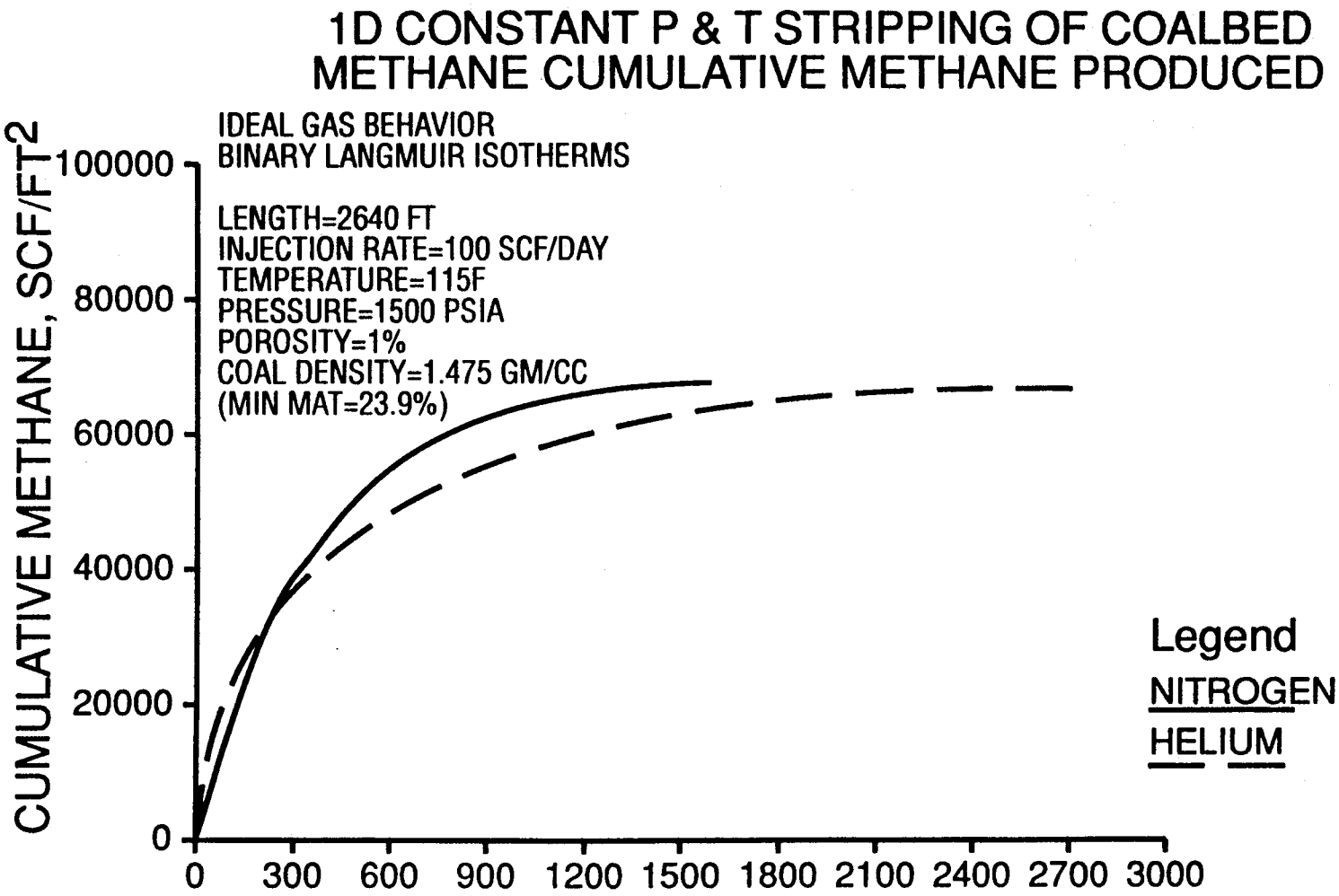
FIG. 1 is a graphical representation of cumulative volume of methane recovered versus time for the injection of helium and for the injection of nitrogen.

To better illustrate the benefits of the methods of the present invention, reference is made to FIG. 1 which illustrates a projected cumulative volume of methane recovered versus time for the injection of helium and of nitrogen. FIG. 1 is a graphical output of data generated using a commercially available reservoir modeling program with the following assumptions and inputs: assume ideal gas behavior, utilize binary langmuir isotherms, assume a wellbore spacing between an injection well and a production well of 2,640 ft., unit cross-sectional area, an injection rate of 100 SCF/day, formation temperature of 115° F., a formation pressure adjacent the wellbores of 1,500 PSIA, a formation porosity of b 1%, coal density of 1.475 GM/CC, and a mineral matter content of 23.9%.

As can be seen, the projected volume of helium recovered is greater than that of nitrogen for about the first 225 days, but thereafter it is less than nitrogen. This decrease for helium as compared to nitrogen's increase is believed to be caused by a minor portion of the nitrogen being sorbed onto and into the cleat system of the solid carbonaceous material. However, approximately 100% of the injected volume of the helium desorbs methane by a stripping action and reduces the partial pressure of the methane more quickly than as compared to nitrogen so the cleat system becomes gas saturated more quickly. The reason the projected methane recovery for nitrogen exceeds that of helium after about the first 225 days is believed to be caused by helium's inability to adsorb to the solid carbonaceous material. Thus, no displacement of methane by helium can occur—only stripping.

Since commercially available supplies of helium in volumes sufficient for a methane recovery project are very expensive as compared to $CO_2$ or nitrogen, prior to the present invention an operator would not be directed to utilize helium. However, the inventors hereof have found that the early benefits of injecting a fluid having helium as a major constituent can be combined with the later benefits of injecting a fluid having nitrogen as a major constituent, as will be described below. Further, by injecting the first fluid and then the second fluid the problem of relative permeability effects, described above, can be overcome to provide increased fluid injection rates and thereby increased methane recovery rates of methane earlier in the project.

Figure 2:
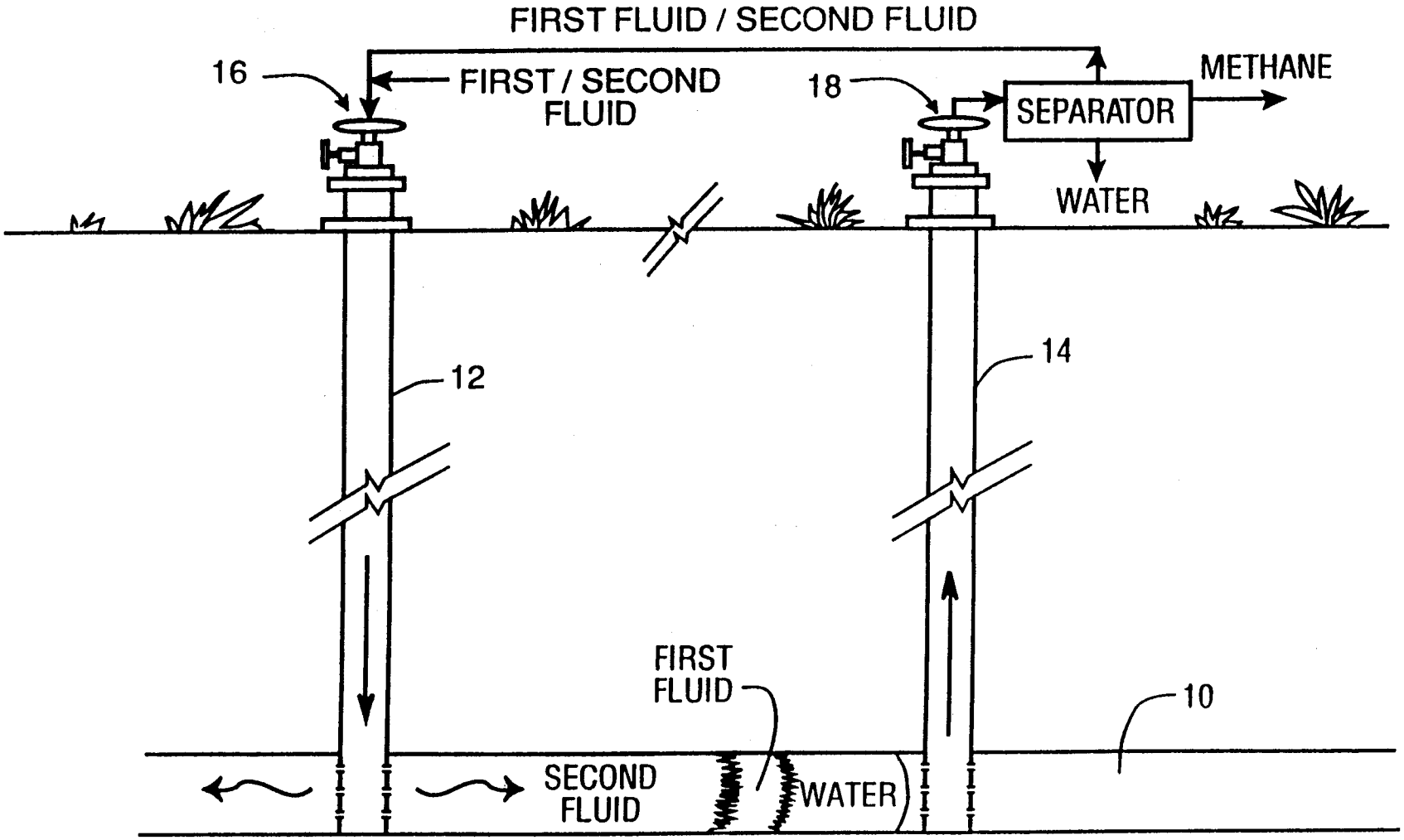
FIG. 2 is a cross-sectional view of at least one injection well and at least one production well both penetrating a solid carbonaceous subterranean formation and utilized for the recovery of methane in accordance with the preferred methods of the present invention.

To further assist in the understanding of the present invention, the methods of the present invention will be described with reference to FIG. 2. In FIG. 2, a subterranean formation of solid carbonaceous material 10 is penetrated by at least one injection well 12 and at least one production well 14. The number of wells 12, 14 and their spacing and arrangement are dictated by the depth of the material, the material's physical characteristics and the like, as all are well-known to those skilled in the art. In FIG. 2 the wells 12, 14 are shown as being cased, cemented and perforated; however, any form of completion arrangement can be utilized, again as are well-known to those skilled in the art.

The at least one injection well 12 is operatively connected to commercially available fluid injection devices, such as valves, pumps, meters, gauges and the like, usually located in or adjacent to a wellhead, and will collectively be referred to as injection equipment 16. Further, the at least one production well 14 is operatively connected to commercially available fluid recovery devices, such as valves, chokes, surface or wellbore pumps, meters, gauges and the like, usually located in or adjacent to a wellhead, and will be collectively referred to as production equipment 18.

In the practice of one preferred method of the present invention, a test is made as to the relative permeability effects in a subterranean formation to determine if a desorbing fluid can be injected at the rate desired without exceeding a predetermined bottomhole pressure limitation. This test can be an injectivity test, as is well-known to those skilled in the art. As an alternative, no actual test need be conducted if from log, core, production and/or offset well information the operator determines that the injection of the desorbing fluid cannot be accomplished at the rate desired. Obviously, if the operator determines that the desorbing fluid can be injected at the rate desired without exceeding the predetermined bottomhole pressure limitations then the operator will proceed with the desorbing fluid injection in any manner desired, as described above.

If, however, relative permeability effects are to be overcome, then the practice of one preferred method of the present invention will be initiated by selecting a first fluid to be injected through the at least one injection well 12. The purpose of this first fluid is to relatively rapidly flow through the cleat system without being sorbed to any significant extent by the subterranean formation and cause methane to be desorbed. This desorbtion occurs by the lowering of the partial pressure of methane in the cleat system, displacement of water from the cleat system around the injection wellbore, and the increase of the relative permeability to gas around the injection wellbore. This first fluid should have a relatively high desorbing efficiency to accomplish the above purposes. Because of its availability and relatively high desorbing efficiency the first fluid is preferably comprised of a gas having helium as the major constituent. More preferably, the first fluid consists essentially of helium.

The duration of injection of the first fluid can vary, and can be from about a few days to as long as about two years. For example, the injection of the first fluid can be continued until about 10% formation pore volume of the first fluid is injected. The rate at which the first fluid is injected can be constant or varied, and is preferably injected as fast as possible, such as for example from about 25 MCF/D to about 25,000 MCF/D. The injection pressure of the first fluid measured at the wellbore adjacent the subterranean formation can be constant or varied, and is controlled by the injection equipment 16. This injection pressure is preferably below the fracture pressure of the solid carbonaceous material to prevent unnecessary movement of the first fluid away from the near injection wellbore area. However, after an initial volume of the first fluid has been injected, the operator can choose to exceed the fracture pressure to fracture stimulate the subterranean formation with the first fluid to increase the subterranean formation's near wellbore permeability.

The injection of the first fluid is ceased when tests indicate that any relative permeability effects have been overcome, such as indicated by the ability to inject fluid at a higher rate than previously without exceeding the pressure limitations, or after a predetermined volume of the first fluid has been injected Alternately, the injection of the first fluid is ceased when simulation plots intersect for the first fluid and second fluid. For example, the injection of $N_2$ would be initiated after about 225 days for the example shown in FIG. 1.

The injection of the following second fluid occurs through the same injection well(s) or separate injection well(s), and is preferably continuous with the ceasing of the injection of the first fluid. Alternately, the injection of the first fluid is ceased for one or more injection wells while other injection wells continue the first fluid's injection, or all injection is ceased for a period of time to permit the near wellbore formation pressure to decrease, the bank of the first fluid to dissipate out into the formation, and/or the performance of maintenance on the wells 12 and/or 14 prior to the initiation of the injection of the second fluid.

The second fluid is the primary desorbing fluid used to desorb methane from the subterranean formation in the methane recovery project, so the volume injected is larger than the volume of the first fluid injected The second fluid can be any fluid that desorbs methane with a desorbing efficiency less than the first fluid. Preferably, for economic reasons and availability, the second fluid comprises a gas that has nitrogen as a major constituent. Most preferably, the second fluid is a gas consisting essentially of nitrogen.

While the first fluid is a preflush or spearhead-fluid, the second fluid is the main fluid utilized during the life of the methane recovery project. Thus, the volume, rate, duration and injection pressures utilized for the second fluid can be as those described in any of the above mentioned gas injection processes to desorb methane. Most preferably, the injection of the second fluid is in accordance with the methods described in Puri U.S. Pat. No. 4,400,034. For example, the injection of the second fluid comprises injecting an inert gas, such as a gas consisting essentially of nitrogen, into a solid carbonaceous material at a rate as high as practical without the bottomhole pressure exceeding the fracture pressure of the solid carbonaceous material. The inert gas can be injected for as long as desired, such as 10–20 years, with the recovered methane sold while separated inert gas is reinjected into the subterranean formation through the same and/or separate injection wells to continue the process.

As used herein, the term "inert gas" defines a gas which is an essentially pure gas or a gaseous mixture that has as a major constituent a gas that (i) does not significantly react with solid carbonaceous material in the subterranean formation under conditions of use (i.e., the standard meaning for "inert"), and (ii) does not significantly adsorb to the solid carbonaceous material. Examples of such inert gases include nitrogen, helium, argon, air and mixtures thereof.

The injection of the second fluid is preferably continuous, which means such injection can be stopped for economic or mechanical reasons for a period of time, such as a matter of hours or days.

The inventors hereof believe that the desorption efficiency of the first fluid and the second fluid can be improved if the first fluid and the second fluid are heated to a temperature above the reservoir temperature prior to such injection. For example, in the San Juan Basin of New Mexico the reservoir temperature is about 115° F. The first fluid and/or the second fluid can be heated by means of any commercially available heat exchanger unit, boiler system or engine exhaust heat recovery mechanism to raise the temperature of the gas to about 115° F., but preferably below the solid carbonaceous material's ignition temperature. The higher temperature reduces the adsorption capability of the solid carbonaceous material and, therefore, causes more methane to be desorbed from the near wellbore area.

After the injection of the first fluid and the second fluid has progressed for a period of time, in accordance with the above described preferred methods, banks of the first fluid, the second fluid and desorbed methane will become less and less distinct as slugs or banks, and will tend to mix. This mixture of methane and the first fluid and the second fluid will push a bank of water ahead thereof, with water also becoming mixed with the methane and other fluids, towards areas of relatively lower pressure surrounding the wellbores of at least one production well 14. The fluids removed through the at least one production well 14 can be separated at the surface or downhole within the production well 14 using commercially available separation methods. Separated methane is further processed, if desired, and is introduced into a pipeline for transportation to market. The first fluid is separated from the second fluid and can be recycled by reinjection into the same or separate injection well or wells 12. Also, the second fluid can be recycled by reinjection into the same or separate injection wells 12. By recycling, the quantity of the fluids needed to be added to sustain the desorbtion of the methane recovery project is greatly reduced Also, the separated first fluid and the separated second fluid can be transported by truck or a pipeline to another area where a methane recovery process is to be initiated. In this manner, the recovered and separated first fluid and/or second fluid from a first project area can be reutilized by injection into a second project area.

As an alternate preferred method, the injection of the second fluid is followed by a bank or slug of injected first fluid so that the first fluid and second fluid injection are sequentially continued as alternating banks or slugs to recover as much methane as possible. Additionally, quantities of other available fluids, such as $CO_2$ or flue gas, can be blended into the first fluid and/or the second fluid, as is desired, so long as such fluid(s) does not materially affect the recovery rate increases of the present invention.

Further, separated water from an ongoing adjacent methane recovery project or a previous project can be reinjected into the solid carbonaceous subterranean formation prior to the injection of the first fluid, prior to the injection of the second fluid, or after the injection of the second fluid has been completed to assist in pushing any remaining methane, first fluid and/or second fluid towards the production well(s) 14 for recovery to the surface.

To illustrate one preferred method of the present invention, the following example is provided. A ten square acre project area in San Juan Basin, New Mexico has a coal seam of about 20 ft thick and lies at a depth of about 2800 ft with a bottomhole wellbore pressure of about 1600 psi. A first fluid comprising a gas having helium as a major constituent is injected into the coal seam through at least one injection well at about 2000 psi bottomhole wellbore pressure and at a rate of about 200 MCF/D. This injection is continued for about 50 to about 250 days and is then stopped. Following the injection of first fluid being ceased, a second fluid is immediately injected through the at least one injection well, with the second fluid comprising a gas having nitrogen as a major constituent. The second fluid is injected at about 2000 psi bottomhole wellbore pressure and at a rate of about 200 MCF/D. A mixture of desorbed methane, first fluid, second fluid and water are moved towards four spaced apart corner production wells forming a five-spot pattern together with the injection well. First fluid, second fluid, methane and water are recovered through the production wells to the surface where the methane is separated and transported. The recovered first fluid and second fluid are individually separated and the first fluid is transported by a pipeline to an adjoining project area, where the first fluid is reused in a subsequent initiation of the methane recovery process of the present invention. The separated second fluid is recycled by reinjection through the injection wells to continue the methane recovery process for an additional 2–4 years.

Whereas, the present invention has been described in particular relation to the examples included herein and the drawings attached hereto, it should be understood that other and further modifications, apart from those shown or suggested herein, may be made within the scope and spirit of the present invention.

What is claimed is:

1. A method of recovering methane from a solid carbonaceous subterranean formation, penetrated by at least one injection well and at least one production well, the method comprising:

(a) injecting a first fluid that desorbs methane into the subterranean formation through at least one injection well;

(b) injecting a second fluid that desorbs methane into the subterranean formation through at least one injection well, the second fluid having a desorbing efficiency less a desorbing efficiency of the first fluid; and (c) recovering methane through the at least one production well.

2. The method of claim 1 and further comprising ceasing the injection of the first fluid, and then initiating the injection of the second fluid.

3. The method of claim 1 wherein the second fluid is injected into the at least one injection well used in step (a).

4. The method of claim 1 wherein the first fluid is injected at a pressure less than a fracture pressure of the subterranean formation.

5. The method of claim 1 wherein the volume of the first fluid injected is less than the volume of the second fluid injected

6. The method of claim 1 wherein the first fluid comprises a gas having helium as a major constituent.

7. The method of claim 1 wherein the second fluid comprises a gas having nitrogen as a major constituent.

8. The method of claim 1 wherein the first fluid consists essentially of helium and the second fluid consists essentially of nitrogen.

9. The method of claim 1 and further comprising recovering methane, the first fluid and the second fluid through the at least one production well.

10. The method of claim g and further comprising separating recovered second fluid from recovered methane, and reinjecting the separated second fluid into the subterranean formation through at least one injection well.

11. The method of claim g and further comprising separating recovered first fluid and recovered second fluid from recovered methane, and reinjecting the separated first fluid and the separated second fluid into the subterranean formation through at least one injection well.

12. The method of claim 1 and further comprising recovering water, methane, first fluid and second fluid; separating the recovered water from the methane, first fluid and second fluid; and reinjecting the separated water into the subterranean formation.

13. The method of claim 1 and further comprising sequentially repeating steps (a) and (b).

14. A method of recovering methane from a solid carbonaceous subterranean formation, penetrated by at least one injection well and at least one production well, the method comprising:

(a) injecting a first gas having helium as a major constituent into the subterranean formation through at least one injection well;

(b) ceasing the injection of the first gas and then injecting a second gas having nitrogen as a major constituent into the subterranean formation through the at least one injection well;

(c) recovering methane, the first gas and the second gas through the at least one production well;

(d) separating the second gas from methane; and (e) reinjecting the separated second gas into the subterranean formation through the at least one injection well.

* * * * *

UNITED STATES PATENT AND TRADEMARK OFFICE

CERTIFICATE OF CORRECTION

PATENT NO. : 5,099,921

DATED : March 31, 1992

INVENTOR(S) : Rajen Puri, Dan Yee, and Robert S. Metcalfe

It is certified that error appears in the above--identified patent and that said Letters Patent is hereby corrected as shown below:

Col. 8,
Claim 10, line 1, "g" should read -- 9 --.

Col. 8,
Claim 11, line 1, "g" should read -- 9 --.

Signed and Sealed this

First Day of June, 1993

*Attest:*

Michael K. Kirk

MICHAEL K. KIRK

*Attesting Officer*

*Acting Commissioner of Patents and Trademarks*